United States Patent [19]

Becker

[11] 4,204,471

[45] May 27, 1980

[54] PRINTING MACHINE TRANSFER DRUM ADJUSTABLE TO VARIABLE SHEET LENGTHS

[75] Inventor: Willi Becker, Bammental, Fed. Rep. of Germany

[73] Assignee: Heidelberger Druckmaschinen Aktiengesellschaft, Heidelberg, Fed. Rep. of Germany

[21] Appl. No.: 816,687

[22] Filed: Jul. 18, 1977

[30] Foreign Application Priority Data

Jul. 17, 1976 [DE] Fed. Rep. of Germany ..... 2632243

[51] Int. Cl.[2] ..... B41F 1/30

[52] U.S. Cl. ..... 101/410; 101/232; 271/277; 29/118; 271/314

[58] Field of Search ..... 29/113R, 117, 116; 101/230–232, 407–410; 271/80, 276, 277

[56] References Cited

U.S. PATENT DOCUMENTS

| | | | |
|---|---|---|---|
| 2,564,335 | 8/1951 | Lake | 74/568 |
| 2,723,570 | 11/1955 | Herrmann | 74/568 |
| 3,372,708 | 3/1968 | Hotchkin | 74/568 |
| 3,829,084 | 8/1974 | Jurny | 101/230 |
| 3,944,218 | 3/1976 | Cerny | 271/277 |
| 4,014,261 | 3/1977 | Becker | 101/230 |
| 4,024,814 | 5/1977 | Becker | 271/277 |

*Primary Examiner*—William Pieprz
*Attorney, Agent, or Firm*—Herbert L. Lerner

[57] ABSTRACT

A printing machine sheet transfer drum adjustable to variable sheet lengths has sheet carriers forming respective meshing comb-like structures adjustable relative to one another, and devices for gripping the leading and trailing edges of a sheet. The gripping devices are disposed in channels of the transfer drum and secured to the sheet carriers, the gripping devices having at least one continuous sheet-supporting rail extending from side to side of the sheet transfer drum. The transfer drum has a rigid main drum body integral with one of the comb-like structures and formed of at most two separable parts including the device for gripping the leading edge of the sheet, and a hollow, substantially cylindrical body partly surrounding the main drum body in circumferential direction thereof. The device for gripping the trailing edge of the sheet being disposed on the hollow body and forming therewith a rotatable sheet carrier unit.

9 Claims, 9 Drawing Figures

PRINTING MACHINE TRANSFER DRUM ADJUSTABLE TO VARIABLE SHEET LENGTHS

The invention relates to a transfer drum which is adjustable to accommodate variable sheet lengths and is provided with sheet carriers which are adjustable comb-like relative to one another. To the sheet carriers are fastened devices in the drum channels for gripping the leading and trailing edges of the sheets, as well as at least one continuous sheet support rail.

As is well-known, in perfecting machines having three drums between respective pairs of successive printing units, the sheet to be printed is transferred during sheet travel in perfector printing from the first transfer drum to the second transfer drum with the leading edge of the sheet in front. After being transferred, the sheets are straightened out or aligned on the second transfer drum, so that in perfector printing, the transfer of the sheet in correct register is assured.

The sheet aligned in this manner is then guided past the tangent point between the second transfer drum and the next-succeeding turning drum. As soon as the trailing edge of the sheet held by the suction devices of the second transfer drum reaches the tangent point, it is gripped by the gripping mechanism of the succeeding turning drum.

At the same time that the trailing edge is gripped, the leading edge of the sheet is freed by the front gripper of the second transfer drum and, with the trailing edge leading, the sheet is transferred to the next impression cylinder for printing the reverse side of the sheet.

It is therefore especially important for the transfer of the sheet in correct registry between the successive printing units during perfector work i.e. printing on both sides of the sheet, that the sheet should be aligned in correct registry on the second transfer cylinder. Correct registry is especially important for the trailing edge which becomes the guide edge on the transfer sheet to the following turning drum, and thus the leading edge of the sheet in the succeeding printing unit. Even if there should be extremely small deviations of the position of the trailing edge of the sheet on the second transfer durm, inaccurate registry will be caused by non-coinciding retransfer of ink by the counter pressure cylinder of the second printing unit acting on the printing on the front side of the sheet, and this will be visible in the form of mackling.

German Published Non-Prosecuted Applications DT-OS Nos. 22 27 151, 22 28 671, 23 16 161, German Pat. DT-PS No. 16 11 241, German Utility Model or Petty Patent DT-GM No. 69 49 916 and German Published Prosecuted Application DT-AS No. 23 58 223, all described various types of transfer drums of the kind indicated hereinabove and are representative of the prior art. All of these heretofore known devices have the common disadvantage that the transfer drums are formed of a larger or smaller number of individual sheet carrier discs or sheet segments which are disposed side-by-side on a carrier shaft. Some of these sheet carrier discs, which are provided with the gripper device for gripping the leading edge of the sheet, are fastened to the carrier shaft while the other sheet carrier discs, provided with the trailing edge grippers of suckers, are mounted rotatably on the carrier shaft.

Since, however, every bearing must have some play resulting from the necessary tolerances of both the shaft and the bore, a disposition of this general type has an extremely detrimental effect on the true running of the sheet carrier discs. This results in faulty peripheral and lateral register.

Aside from these disadvantages, the construction of heretofore known transfer drums must be regarded as problematic because of their numerous components.

In addition, in the device of German Patent DT-PS No. 16 11 241, German Published Non-Prosecuted Application DT-OS Nos. 22 27 151, 22 28 671, 23 16 161, and of German Utility Model or Petty Patent DT-GM No. 69 49 816, connecting and control parts for the gripper or sucker devices pass through the carrier discs, which must therefore be provided with corresponding cutouts and slots, thus resulting in a weakening of the individual carrier discs and impairment of the rigidity thereof. The limitation of the range of sheet size or format adjustibility of the transfer drums also resulting therefrom is only mentioned incidentally.

Because of the limitation in the sturdiness of construction which necessarily results from the spacing of the individual segments, the dimensions of the apertures, and because of the consequently small dimensions of the control parts for the gripping or suction devices for the leading or trailing edges of the sheet, the individual components may be subject to vibration and bending, which may lead to inaccurate registry both in single-side and in perfector or double-side printing. In the case of the transfer drums of German Published Non-Prosecuted Applications DT-OS Nos. 22 27 151 and 22 28 671, this is further enhanced by the relatively loose connection of the individual components.

Finally, the elaborate construction of all the known devices mentioned hereinabove, also entails high manufacturing costs, as well as difficult assembly of the transfer drums with time-consuming adjustment of the individual sheet carrier discs.

It is accordingly an object of the invention of the instant application to provide a transfer drum for printing machines that is adjustable to variable sheet lengths, wherein the disadvantages of the heretofore known devices of this general type are eliminated and a transfer drum is provided for processing variable sheet sizes, in which, as a result of compact construction, the greatest possible rigidity is ensured and the highest accuracy is provided for effecting true running of the drum, while requiring only a small number of bearings and components.

With the foregoing and other objects in view, there is provided in accordance with the invention, a printing machine sheet transfer drum adjustable to variable sheet lengths, the transfer drum having sheet carriers adjustable comb-like relative to one another and devices for gripping the leading and trailing edges of a sheet, the gripping devices being fastened to the sheet carrier in drum channels formed in the transfer drum and having at least one continuous sheet-supporting rail, the transfer drum further has a main drum body formed of at most two parts and including the device for gripping the leading edge of the sheet and a hollow body partly surrounding the main drum body, the device for gripping the trailing edge of the sheet being disposed on the hollow body and forming therewith a rotatable sheet carrier unit.

A simple construction of this type with a small number of components permits economical production with low manufacturing costs, relatively easy and rapid assembly of the transfer drum which does not affect the accuracy previously achieved in manufacture, and ease of operation. The elimination of the bearing tolerances of the numerous individual sheet carrier discs of the heretofore known devices of this general type enables maximum accuracy to be achieved because of the small number of bearings required. Maximum accuracy, in turn, provides for the true running of the entire transfer drum, which naturally has an extremely advantageous effect on accuracy of registry, particularly when performing perfector printing.

Since the gripper device for gripping the front edge of the sheet is fastened to the solid main body of the drum and not to individual rotatable sheet carrier discs as in all of the herertofore known devices of this general type, absolutely correct sheet transfer is also ensured, especially for single-side sheet printing.

In accordance with another feature of the invention, the main drum body is bipartite and includes a cylinder and a separate axle whereon the cylinder is mounted, and the hollow body is of unipartite construction.

This provides an especially simple construction which promotes cost-saving manufacture and ease of assembly and exchangeability of one of the two sheet carrier units, in the event of damage.

In accordance with a further feature of the invention, the main drum body is of unipartite construction, and the hollow body is formed of a plurality of parts.

This serves to improve the compactness of the construction of the transfer drum and its rigidity.

In accordance with an additional feature of the invention, both the main drum body and the hollow body are castins having respective sheet carriers integral therewith.

This achieves a construction which is particularly rigid and free from vibration.

In accordance with yet another feature of the invention, the hollow body is formed of a bipartite outer shell disposed between two adjusting discs mounted on the main drum body, the hollow body being threadedly secured to the adjusting discs.

In accordance with a still further feature of the invention, a part of the bipartite outer shell is a casting extending continuously over the entire width of the transfer drum, the casting having a widened cross section forming a cross member at one side thereof, the device for gripping the trailing edge of the sheet and having the continuous sheet-supporting rail being fixed to the casting.

In accordance with yet an additional feature of the invention, a part of the bipartite outer shell is formed of a suction bar having a relatively large cross section and a continuous sheet support rail, and including sheet carriers disposed adjacent and spaced from one another and secured to the support rail.

In accordance with an added feature of the invention, arresting means are provided for securing the hollow body to the main drum body.

In accordance with a concomittant feature of the invention, the arresting means include mutually cooperating adjusting discs, clamping straps and threaded clamping fasteners, and further including a clamping ring fastened in the main drum body, the adjusting discs together with the rotatable sheet carrier unit being anchorable by means of the threaded clamping fasteners and the clamping straps to the clamping ring.

Although the invention is illustrated and described herein as embodied in printing machine transfer drum adjustable to variable sheet lengths, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof, will be best understood from the following description of specific embodiments when read in connection with the accompanying drawings, in which.

Figure 2:
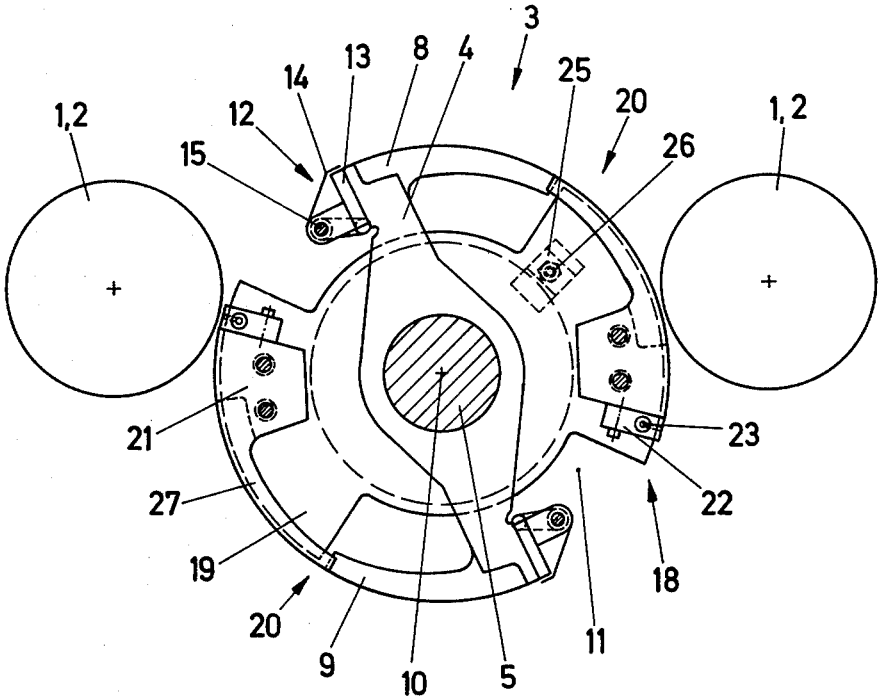
FIG. 2 is a diagrammatic cross-sectional view of FIG. 1 taken along the line A–B in the direction of the arrows and showing the basic structure of the transfer drum for processing large sheet sizes or formats, and adjusted to maximum sheet size.
Figure 3:
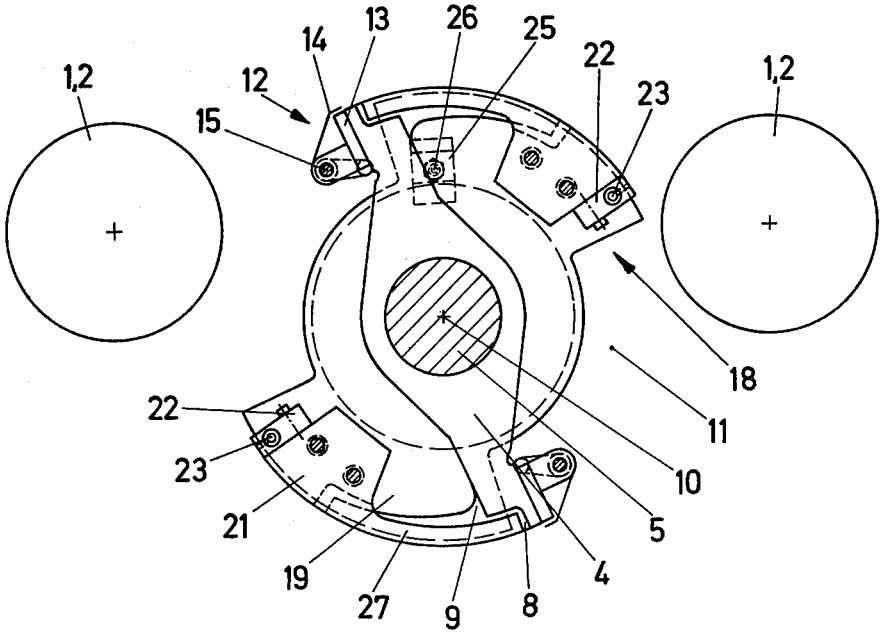
FIG. 3 is a view of the transfer drum similar to that of FIG. 2, with the drum adjusted, however, to minimum sheet size or format.
Figure 9:
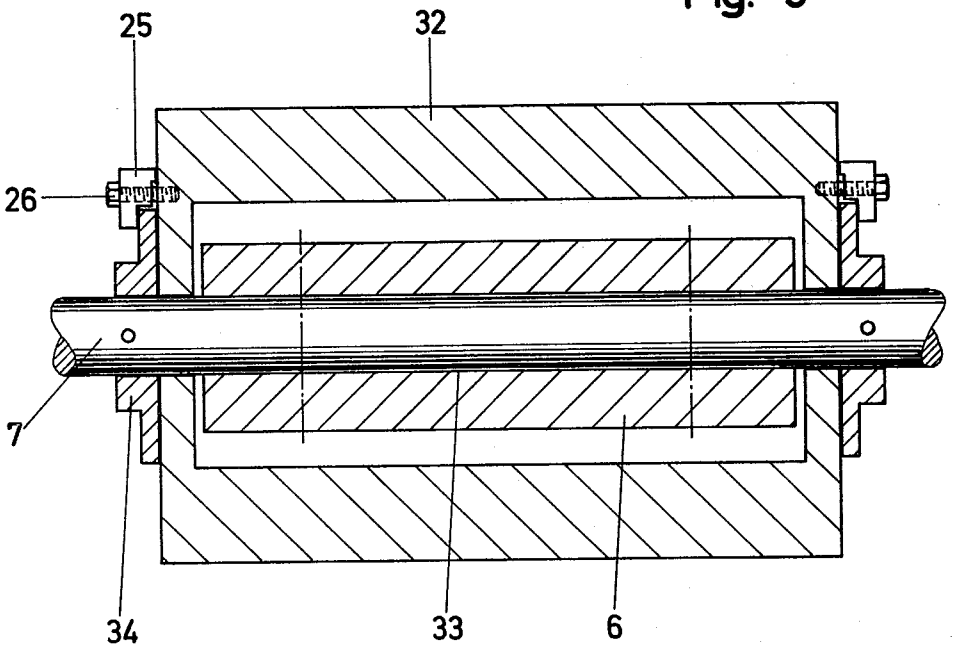
FIG. 9 is a longitudinal sectional view of FIG. 8 taken along the line C–D in the direction of the arrows.

Referring now to the figures of the drawings and first, particularly, to FIGS. 2 to 7, a transfer drum 3 having a diameter twice that of the impression cylinder is shown, disposed between a preceding and a succeeding transfer or impression cylinder 1, 2, respectively. The main drum body 4 of the transfer drum 3 is in the form of a fan wheel or impeller and is preferably constructed solidly in one casting and provided with integrally cast bearing journals 5. It may, however, also be of multipartite construction in the form of a cylinder 6 with a separate axis 7, and may be of forged or welded construction (FIGS. 3 and 9).

The main drum body 4 has a core cross section which is widened in order to increase stiffness and which is tapered in cross section on both sides in the form of arms or projections extending towards the surface thereof.

In the surface of the two projections or arms of the main drum body 4, recesses 8 are provided lying side-by-side stepwise, so that the surface of the body 4 is composed of alternate projections and depressions. As extension of these surface projections, the base drum body 4 is provided on one side of each of the two arms or projections thereof with integrally cast sheet carriers 9 having the shape of a circular arc and likewise extending stepwise adjacent one another over the entire width of the drum (FIGS. 1 to 5).

Figure 1:
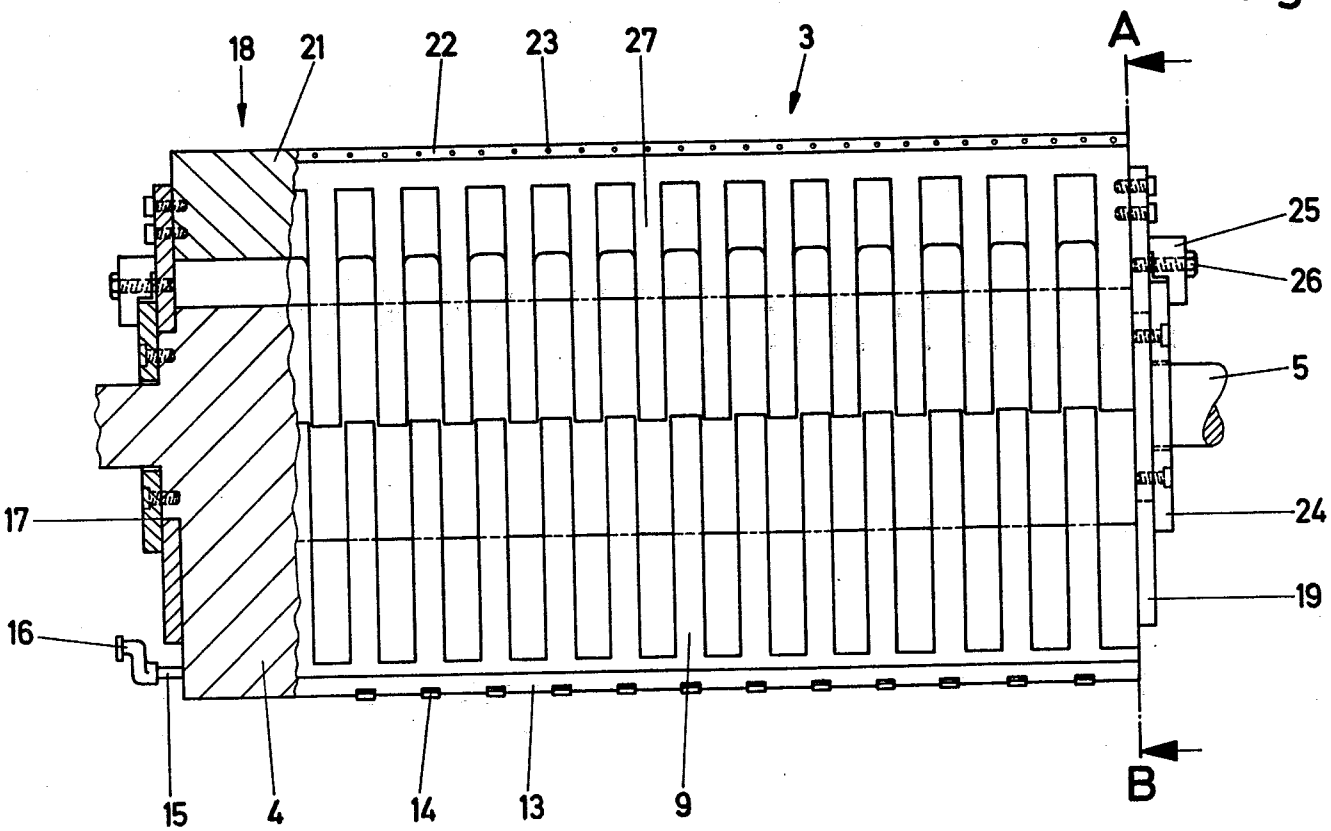
FIG. 1 is a diagrammatic longitudinal view, partly in section, of the basic structure of the transfer drum of the invention.

The side of the arms or projections of the main drum body 4 opposite that where the integrally cast sheet carriers 9 are disposed is kept planar and is aligned radially to the rotary axis 10 of the transfer drum 3. On each of these planar sides, a device 12 for gripping the front edge of the sheet is threadedly or otherwise secured, a maximal number of fastening points being provided on the main body 4 of the drum. The device 12 for gripping the front edge of the sheet is in the form of a gripper device including a continuous gripper bar 13 and grippers 14, as can be seen in FIG. 1. The grippers 14 are controlled by means of a cam roller 16 fastened to the end of the control shaft 15 (FIG. 1).

The main drum body 4 together with the journal 5 and the arcuate sheet carriers 9 can thus be formed of one casting and can be finished conjointly. This casting, together with the gripper bar 13 fastened thereto, forms a solid, sturdy, fixed sheet carrier unit.

As is apparent from FIGS. 1 to 7, the main drum body 4 is provided at the end faces thereof with attachments 17 on which a hollow body 18 is mounted free of play as a rotatable sheet carrier unit with the finest tolerances of fit. The hollow body 18 is formed of two lateral adjusting discs 19 and a peripheral wall 20 inserted therebetween. The peripheral shell may be formed of one or more parts; in practice, it is preferably of bipartite construction in the embodiments illustrated in FIGS. 1 to 7.

The attachments 17 of the main drum body 4 are paired with the bores of the adjusting discs 19 in the form of a sorted selected fit in order to eliminate any existing play. In addition, it would be fully conceivable to equip the two remaining bearings with special adjusting means which are well-known in the art and therefore not illustrated, such as eccentric rollers, for example, in order to eliminate play.

Figure 4:
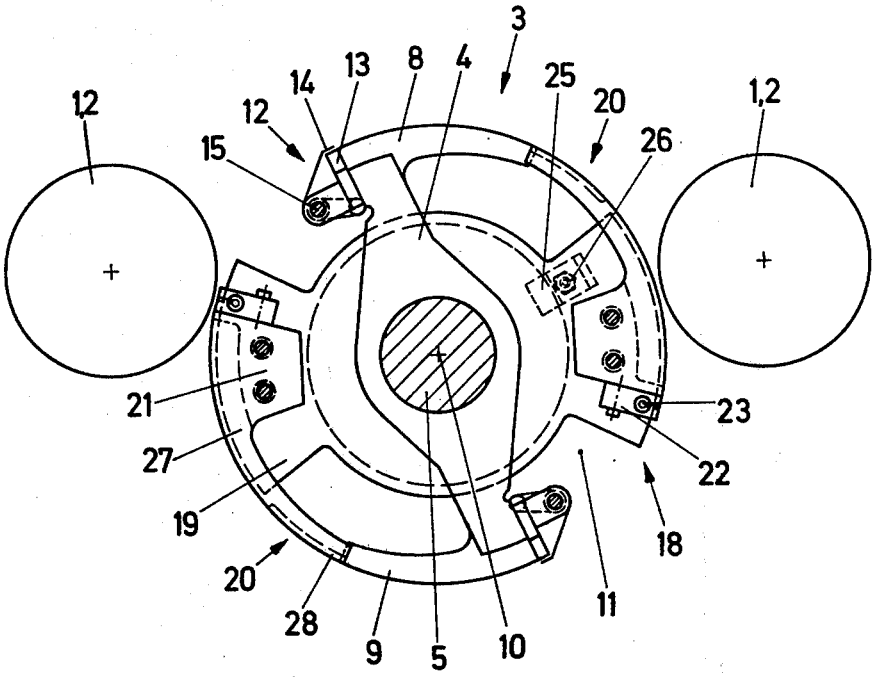
FIG. 4 is a diagrammatic cross-sectional view, similar to that of FIG. 2, of a first practical embodiment of the invention showing the transfer drum for processing medium sheet sizes or formats, adjusted to maximal format.
Figure 5:
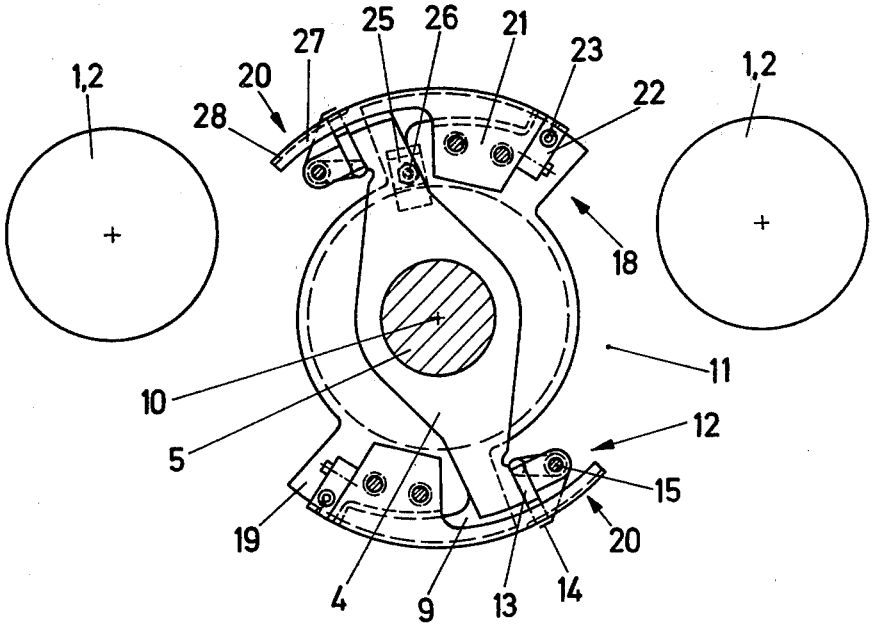
FIG. 5 is a view similar to that of FIG. 3, of the first embodiment of FIG. 4 with the drum adjusted to minimum sheet size or format.

In the basic construction or structure of the transfer drum which is illustrated in FIGS. 1 to 3, and in the first practical embodiment in FIGS. 4 and 5, each part of the peripheral shell 20 is of unipartite construction in the form of a solid casting which is continuous over the entire width of the drum. One end of the casting 21, which faces the drum channel 11, when clamped between the adjusting discs 19, is considerably widened in cross-section and constructed as a traverse or cross member. The cross member accommodates the threaded connection of the casting 21 between the two adjusting discs 19 and serves also as a sturdy carrier for the threadedly secured device 22 for gripping the rear edge of the sheet. Like the gripper bar 13 in the basic structure of the transfer drum 3, shown in FIGS. 1 to 3, the device 22 for gripping the rear edge of the sheet is equipped with a continuous sheet support rail.

Since the casting 21 extends continuously over the entire width of the drum and therefore no segment spacing need be taken into account, the suction bar 22 can be fixed at any desired number of locations on the casting 21. In addition, the largest possible number of suckers or suction locations 23 can be provided independently of the segment spacing.

The solid castings 21 which are tightly screwed together with the suction bars 22 fastened thereto between the adjusting disc 19, form a sturdy sheet carrier unit which is particularly vibration-free. This is another solid unit like the drum body 4 with the threadedly secured gripper bar 13, the integrally cast sheet carriers 9, and the journals 5.

The hollow body 18 is mounted for rotation on the attachments 17 of the main drum body 4 by means of the adjusting discs 19. In front of the hollow body 18 mounted in this manner are clamping rings 24, which are fastened to the main drum body 4, and disposed on both sides on the journals 5. On the two adjusting discs 19 clamping plates 25 are disposed covering the clamping rings 24 and fastenable by means of clamping screws 26 (FIG. 11).

In the basic construction of the transfer drum 3 (FIGS. 1 to 3), which is especially used for processing large sheet sizes or formats, the recesses 8 formed in the surface of the arms of the main drum body 4 are not made continuous, but are incised or otherwise formed only in a part of the surface. This provides the advantage that the sheet support surface on which the leading edge of the sheet comes to lie, can be made continuous. To adjust the transfer drum 3 for processing the smallest possible size in this large sheet size or format range, the sheet carriers 27 of the castings 21 are shifted so far that they extend into the recesses 8 formed in the main drum body 4, as shown in FIG. 3.

In a first practical embodiment of the invention which is illustrated in FIGS. 4 and 5 and which is especially suitable for processing sheets in middle size or format range, the recesses 8 formed in the surface of the arms or projections of the main drum body 4 are made continuous. With this construction, the adjustment of the transfer drum for the purpose of processing the smallest possible sheet or format, in accordance with FIG. 4, the sheet carriers 27 of the castings 21 can travel through the recesses 8. Due to this disposition, the sheet size or format range is considerably broadened or extended i.e. processing smaller sizes or formats is also afforded. In this case, however, the ends of the rotatable sheet carriers 27, which extend beyond the gripper bar 13 and into the drum channels 11, must be provided with a recess 38 so that sheet gripping means of the preceding or succeeding transfer or impression cylinder 1, 2 can extend or dip into the path of rotation of the transfer drum 3.

Figure 6:
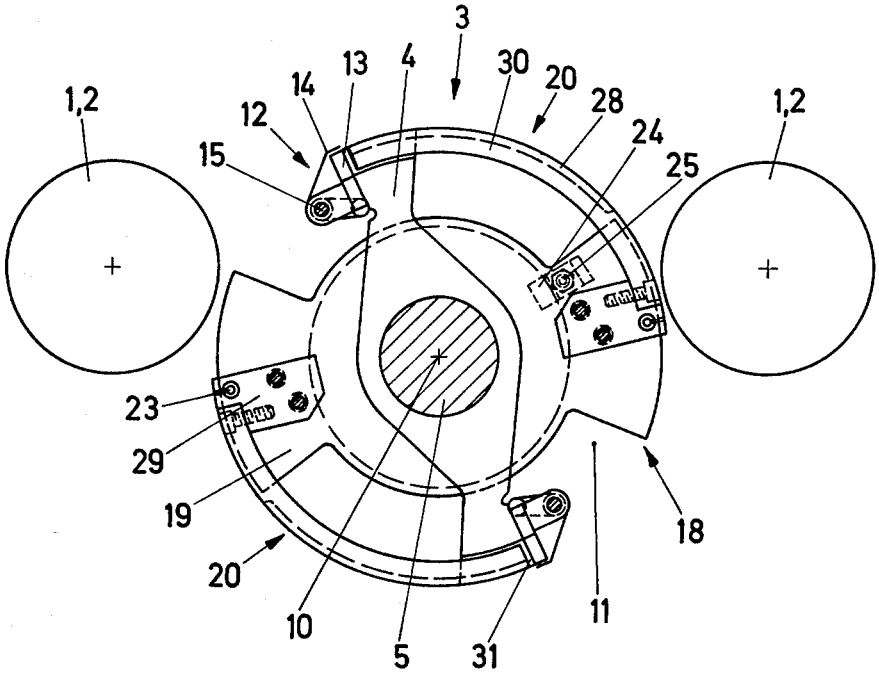
FIG. 6 is a diagrammatic cross-sectional view similar to that of FIG. 4 of a second practical embodiment of the invention showing the transfer drum for processing small sheet sizes or formats, adjusted to maximal format.
Figure 7:
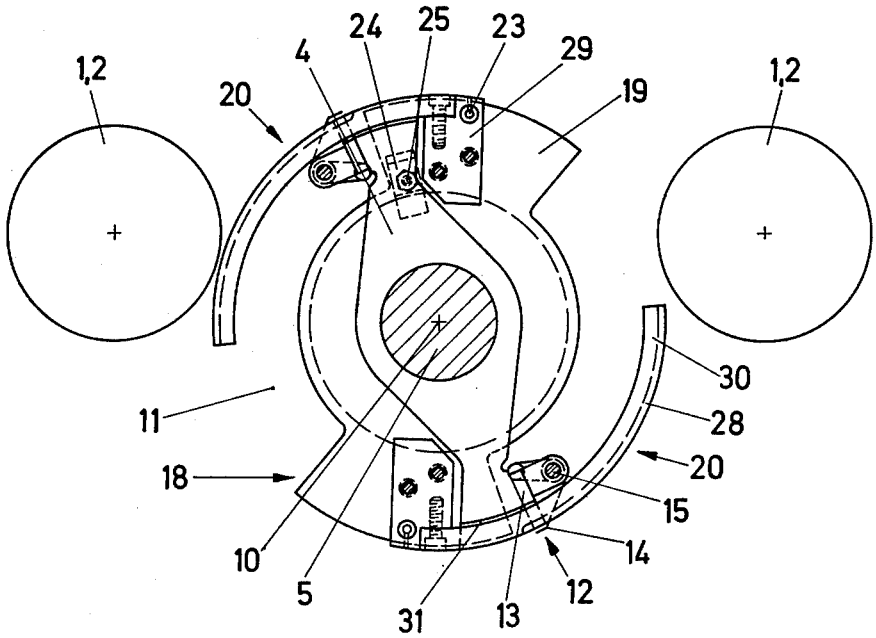
FIG. 7 is a view similar to that of FIGS. 3 or 5 of the second embodiment of FIG. 6 with the drum adjusted to minimum sheet size or format.

A second practical embodiment of the construction of a transfer drum, which is a modification of the construction of FIGS. 1 to 5 and which is intended especially for processing very small sheet sizes or formats, is illustrated in FIGS. 6 and 7. Since the diameter of the transfer drum 3 is correspondingly reduced in machines used for small sheet sizes or formats, less deflections and vibrations occur in this embodiment than with larger transfer drums, because of the smaller masses thereof. For this reason, the necessary rigidity can be achieved with a comparatively lighter construction.

Deviating from the hereinafore described embodiments, no sheet carriers are integrally cast on the main drum body 4 of the embodiment of FIGS. 6 and 7, because the surface of the two arms or projections of the main drum body 4 functions as a sheet carrier surface per se. As a further modification of the basic embodiment of FIGS. 1 to 3 and of the first embodiment of FIGS. 4 and 5, a part of the peripheral shell 20 of the hollow body 18 is formed, respectively, of a sturdy suction bar 29. The suction bar 20 has an extremely large cross section on which arcuate sheet carriers 30 are threadedly secured adjacent one another, side-by-side at intervals on an attachment, thus forming a continuous unitary construction.

In this embodiment of FIGS. 6 and 7, the recesses formed in the surface of the arms or projections of the main drum body 4 are in the form of continuous guiding grooves 31 in which the threadedly secured sheet carriers 30 passing therethrough can be radially supported.

Figure 8:
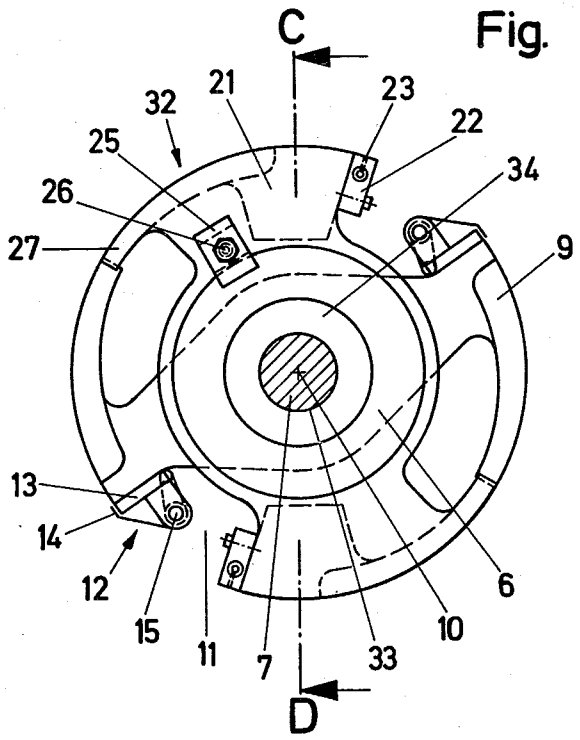
FIG. 8 is a diagrammatic front elevational view of the third practical embodiment of the invention showing the transfer drum adjusted to maximum sheet size or format.

A third practicable embodiment of the transfer drum 3, which is illustrated in FIGS. 8 and 9, has a one-piece hollow body 32, which is preferably formed of a casting, but which may also be produced in other ways, for example by welding. In this embodiment of FIGS. 8 and 9, the main drum body is in the form of a cylinder 6, provided with a bore 33, and fastened by non-illustrated conventional means to the separate axle 7.

At both sides of the one-piece hollow body 32 which is mounted without play on the separate axle 7, fastening discs 34 are fixed on the axle 7, the hollow cylinder 33 being arrestable thereat by means of clamping straps 25 threadedly secured thereto and clamping screws 26.

The adjustment of the transfer drum 3 to the sheet length to be processed is effected in the following manner: The firm or tight connection between the main drum body 4 or 6 and 7, together with the fixed sheet carrier unit, and the hollow body 18 or 32, as well as with the rotatable sheet carrier unit, must first be released. This is achieved by unscrewing the clamping screws 26 on the clamping straps 25, whereby the compressive connection between the clamping rings 24 and the adjusting discs 19, on the one hand, or fastening discs 34 and the one-piece hollow body 32, on the other hand, is released.

After the clamping screws 26 have been loosened, the multipartite hollow body 18, together with the adjusting discs 19 of the one-piece hollow boyd 32 can be turned in peripheral direction either manually or automatically and adjusted to the desired sheet length with the aid of actuating means which are well-known in the art and are therefore not illustrated or further described. After the adjustment has been made, the clamping screws 26 are tightened again, so that the adjusting discs 19 or the fastening discs 34 are pressed and clamped, by means of the clamping plates 25, against the clamping rings 24 anchored in the main drum body 4 or against the one-piece hollow body 32. The transfor drum 3 adjusted in this manner is ready for operation.

The invention is obviously in no way limited to the special embodiments illustrated in FIGS. 1 to 7 and described in the description herein, since these are simply to be regarded as best modes as presently contemplated and are not intended to limit the invention. It is obvious that other embodiments with numerous modifications with respect to structural details, lying within the defined scope of the invention, are also conceivable.

There is claimed:

1. Printing machine sheet transfer drum adjustable to variable sheet lengths, the transfer drum being formed with transverse drum channels and having sheet carriers forming respective meshing comb-like structures adjustable relative to one another, and devices for gripping the leading and trailing edges of a sheet, the gripping devices being disposed in the drum channels and secured to the sheet carriers, the gripping devices having at least one continuous sheet-supporting rail extending from side to side of the sheet transfer drum, comprising a rigid main drum body formed of one piece with one of the comb-like structures and having at most two separable parts including the device for gripping the leading edge of the sheet, and a hollow, substantially cylindrical body partly surrounding said main drum body in circumferential direction thereof and being supported at most at two bearing locations on said main drum body, said hollow, substantially cylindrical body having a one-piece member formed with a surface for supporting a sheet over substantially the entire width thereof, the device for gripping the trailing edge of the sheet being disposed on said hollow body and forming therewith a rotatable sheet carrier unit.

2. Transfer drum according to claim 1 wherein said main drum body is bipartite and includes a cylinder and a separate axle whereon said cylinder is mounted, and said hollow body is of unipartite construction.

3. Transfer drum according to claim 1 wherein said main drum body is of unipartite construction, and said hollow body is formed of a plurality of parts.

4. Transfer drum according to claim 1 wherein both said main drum body and said hollow body are castings having respective sheet carriers integral therewith.

5. Transfer drum according to claim 1 wherein said hollow body is formed of a bipartite outer shell disposed between two adjusting discs mounted on said main drum body, said hollow body being threadedly secured to said adjusting discs.

6. Transfer drum according to claim 5 wherein a part of said bipartite outer shell is a casting extending continuously over the entire width of the transfer drum, said casting having a widened cross section forming a cross member at one side thereof, the device for gripping the trailing edge of the sheet and having the continuous sheet-supporting rail being fixed to said casting.

7. Transfer drum according to claim 5 wherein a part of said bipartite outer shell is formed of a suction bar having a relatively large cross section and a continuous sheet support rail, and including sheet carriers disposed adjacent and spaced from one another and secured to said support rail.

8. Transfer drum according to claim 1 including arresting means for securing said hollow body to said main drum body.

9. Transfer drum according to claim 8 wherein said arresting means include mutually cooperating adjusting discs, clamping straps and threaded clamping fasteners, and further including a clamping ring fastened in said main drum body, said adjusting discs together with said rotatable sheet carrier unit being anchorable by means of said threaded clamping fasteners and said clamping straps to said clamping ring.

* * * * *